United States Patent [19]

Abbott, deceased et al.

[11] Patent Number: 4,738,070

[45] Date of Patent: Apr. 19, 1988

[54] MASONRY WALL TIE UNIT

[76] Inventors: Gary W. Abbott, deceased, late of Pattonville, Tex.; by Betty F. Abbott, heiress, Rte. 1, Pattonville, Tex. 75468

[21] Appl. No.: 934,183

[22] Filed: Nov. 24, 1986

[51] Int. Cl.[4] ..... E04B 1/38

[52] U.S. Cl. ..... 52/710; 52/713; 52/714

[58] Field of Search ..... 52/713, 714, 379, 710, 52/434, 428, 513, 383, 712

[56] References Cited

U.S. PATENT DOCUMENTS

| | | | |
|---|---|---|---|
| 679,324 | 7/1901 | McCall . | |
| 819,869 | 5/1906 | Dunlap . | |
| 1,474,046 | 11/1923 | Lampert . | |
| 1,725,200 | 8/1929 | Lampert . | |
| 1,878,921 | 9/1932 | White | 52/710 |
| 1,988,124 | 1/1935 | Johnson . | |
| 2,089,253 | 8/1937 | Fitz Gerald . | |
| 2,898,758 | 8/1959 | Henrickson . | |
| 3,321,883 | 5/1967 | Pascucci . | |
| 3,341,998 | 9/1967 | Lucas . | |
| 4,021,990 | 5/1977 | Schwalberg . | |
| 4,373,314 | 2/1983 | Allan . | |

*Primary Examiner*—Carl D. Friedman

*Attorney, Agent, or Firm*—Richards, Harris, Medlock & Andrews

[57] ABSTRACT

A brick tie unit comprises a base plate attached to a drywall construction with a plurality of brick ties slideably engaged thereon. The ties are sized to engage the mortar between successive brick layers in a brick veneer. The structure provides a means for frictionally engaging said brick ties to said base plate to prevent longitudinal movement thereof or to selectively release said brick ties to permit movement thereof to a location adjacent the surface of a brick layer to which the tie is attached using wet mortar and successive layers of bricks.

25 Claims, 1 Drawing Sheet

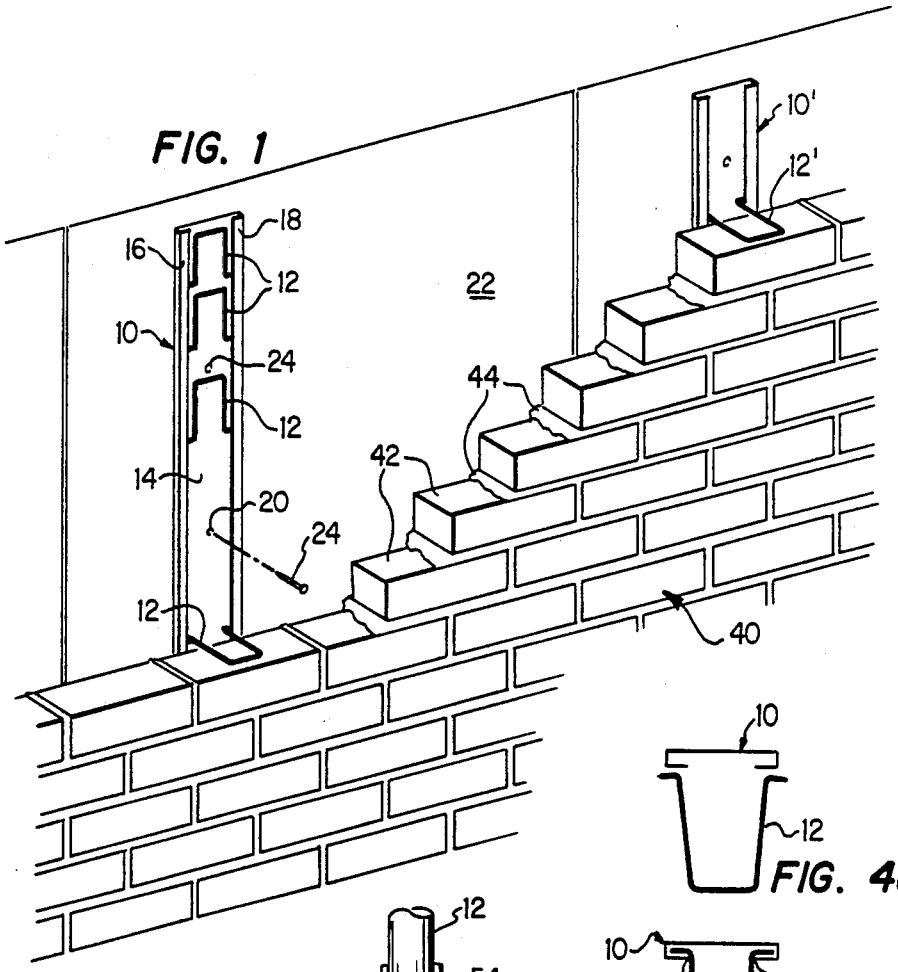
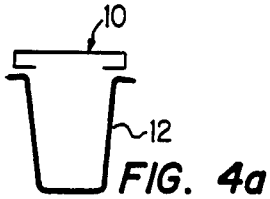
FIG. 4a
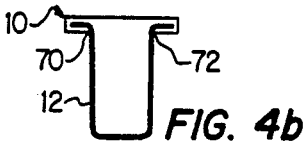
FIG. 4b
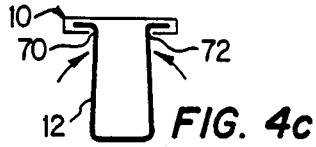
FIG. 4c
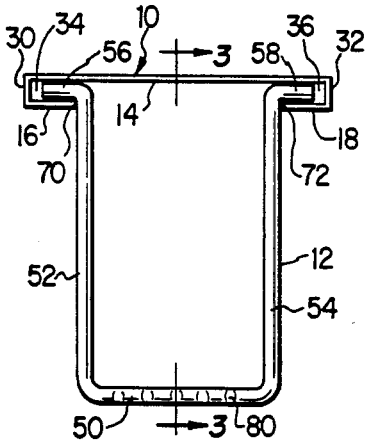
FIG. 2
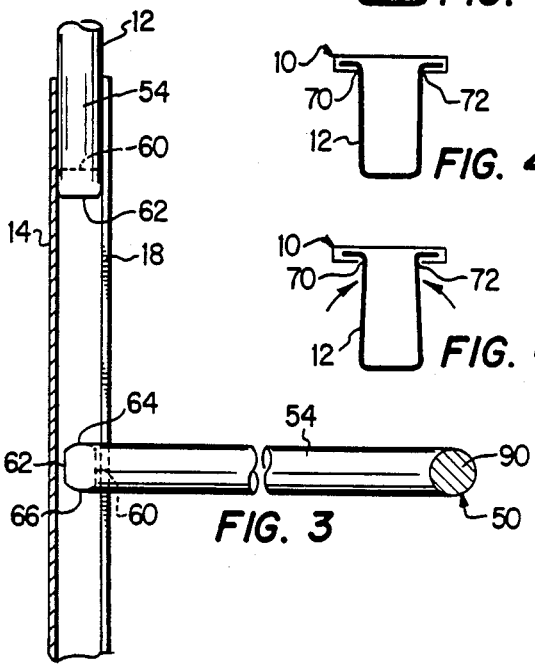
FIG. 3

MASONRY WALL TIE UNIT

TECHNICAL FIELD

The present invention relates to an anchor system for tying a masonry veneer wall to an inner structural wall.

BACKGROUND ART

It is well known in the prior art to use anchors or ties to secure a brick or masonry facade or veneer to a drywall so that the veneer is structurally supported from the drywall to prevent separation therefrom. In particular, the prior art contemplates the use of metal anchors secured to the drywall and tied to the brick or masonry veneer by placement within the mortar or cement between the bricks or masonry.

Generally, the prior art contemplates the use of flexible metal straps which are nailed at one end to the drywall with the opposite end embedded in the mortar or cement between the bricks or masonry. Other prior art brick tie systems include a planar shaped anchor having corrugated surfaces to securely grip the mortar or cement, or having a cutout portion so that the mortar or cement may flow through the anchor to assure that it is securely fixed after the mortar or cement hardens. Examples of such devices are disclosed in U.S. Pat. No. 2,089,253 issued to Gerald and U.S. Pat. No. 2,898,758 issued to Henrickson. These anchors are attached to the drywall support structure by an open faced channel wherein the anchor has a flange or other structure to engage with the channel to permit attachment thereto during construction and to permit location of the anchor within the wet mortar or cement between rows of bricks or masonry.

The prior art also contemplates the use of bent wire anchors to secure a veneer to a drywall structure. In particular, the prior art contemplates wire anchors having various configurations being stapled to the drywall construction, or secured to a flange structure which engages an open faced channel mounted on the drywall construction. Examples of these prior art devices are disclosed in U.S. Pat. No. 3,341,998 issued to Lucas.

The brick tie devices of the prior art suffer numerous disadvantages, such as limited vertical moveability of the anchor and the support structure, difficulty of installation, and multiplicity of parts. Further, the brick tie devices of the prior art comprise a plurality of separate parts which must be assembled prior to use, making transportation to the job site and use thereof difficult. Consequently, a need exists in the art for an apparatus which comprises coordinated system having a base strap which can be attached to the drywall construction with slideably mounted tie structures or anchors which are infinitely adjustable to the level of the brick or masonry to be secured, and are easily installed on a drywall surface prior to the construction of the brick or masonry veneer.

SUMMARY OF THE INVENTION

The present invention comprises a brick tie apparatus having a base plate and a plurality of ties, or anchors, which are slidably mounted on the base plate. In particular, the present invention contemplates the base plate being vertically mounted on a drywall structure and of sufficient length to allow disposition of a plurality of ties between successive rows of bricks or masonry in a wall to securely mount the veneer wall to the drywall structure. The base plate has inwardly folded sides to retain the outer portions of the ties, and to permit a portion of the tie to project from the plate and into the brick or masonry wall.

In another aspect, the apparatus of the present invention contemplates a base plate sized to retain a tie, allowing longitudinal movement thereof when the tie is in a substantially perpendicular position with respect to the base plate, and to secure the tie in a fixed location when the structure is at an acute angle or flat with respect to the base plate. In particular, the present invention contemplates an apparatus whereby a plurality of ties are mounted on a base plate and may be placed in a position prohibiting longitudinal movement thereof during the transportation of the base plate and ties to the job site.

BRIEF DESCRIPTION OF THE DRAWINGS

A more complete understanding of the invention and its advantages will be apparent from the following Detailed Description taken in conjunction with the accompanying Drawings in which:

FIG. 1 is a perspective view of the apparatus of the present invention shown attached to a drywall structure with a brick veneer wall being laid adjacent thereto;

FIG. 2 is a top view of the apparatus of the present invention;

FIG. 3 is a sectional view of the apparatus of the present invention taken along line 3—3 of FIG. 2;

FIG. **4*a* is a top schematic view of the apparatus of the present invention showing a tie removed from the base plate; and FIG. 4*b* is a top schematic view of the present invention showing a tie in its fixed position within the base plate; and FIG. 4*c*** is a top schematic view of the present invention showing the legs of a tie compressed inwardly to permit longitudinal positioning.

DETAILED DESCRIPTION

Referring initially to FIG. 1, the apparatus of the present invention comprises a base plate 10 having a plurality of ties 12 slidably engaged therein so as to be movable to any position along the length of the base strap. Base plate 10 has a base 14 with inwardly turned flanges 16 and 18. Base 14 has a plurality of apertures 20 formed therein and spaced along the length thereof for receiving nails, screws or other fastening means for attaching base plate 10 to the drywall 22. FIG. 1 shows nails 24 exploded from the view for clarity, it being understood that the nails are driven through apertures 20 into a stud or other solid structure in drywall 22. As is seen in FIG. 1, base plate 10 is located between the drywall and a brick veneer 40.

Base plate 10 may be made of any suitable sheet metal material with a 20 or 24 gauge galvanized sheet material being acceptable for most purposes. Ties 12 may be made of appropriate corresponding material, and wire having a 3.5 cm diameter has been found to be acceptable. Of course, these dimension are not critical to practice of the present invention but represent one of many sizes of material which will permit successful practice of the invention.

Ties 12 are slidably engaged with base plate 10 so that the user may locate a tie in the wet mortar or cement between brick layers. In particular, ties 12, as shown in FIG. 1, are located proximate to brick 42 so as to be embedded in mortar 44 as the next layer of bricks is layed. Ties 12 may be placed between successive layers of bricks and serve to tie brick veneer 40 to drywall 22 to prohibit separation of the veneer from the drywall.

As shown in FIG. 1, base plate 10 will normally be used with other base plates, such as base plate 10′ which is also attached to drywall 22. Base plate 10′ employs a plurality of ties with tie 12′ shown located on the surface of a brick prior to the applying mortar 44. It will be understood that the present invention contemplates a plurality of base plates with ties employed along a drywall to secure a brick veneer thereto.

Referring now to FIG. 2, base plate 10 has inwardly turned flanges 16 and 18 connected by transverse sides 30 and 32, respectively, to base 14. Base 14, in conjunction with flanges 16 and 18 and transverse sides 30 and 32, respectively, form parallel channels or slideways 34 and 36, respectively, along the full length of base plate 10. Ties 12 are a U-shaped wire fitting having a cap 50 with legs 52 and 54 extending therefrom with outturned ears 56 and 58 extending from legs 52 and 54, respectively. Ears 56 and 58 engage slideways 34 and 36 as shown in FIG. 2. It will be noticed that cap 50 has an overall width which is less than the dimension between the confronting faces of inwardly turned flanges 16 and 18. Thus, ties 12 may be rotated to the position shown in the upper portion of FIG. 1 such that they lie within flanges 16 and 18 to assume a stored position.

Legs 52 and 54 are a sufficient length such that when in use, the cap 50 and the ends of legs 52 and 54 attached thereto overlie the brick or other masonry block with which the present apparatus is being used. Thus, where a normal offset or gap is provided between the brick and the drywall, tie 12 has an overall height of 8 cm., it being understood that this dimension can be reacily increased or decreased as is necessary to properly position cap 50 and the ends of legs 52 and 54 over the brick or masonry block with which the present invention is used. As is shown in FIG. 1, the overall height of ties 12 are such that the cap 50 of each tie is embedded within the mortar and does not extend beyond the exposed face of the brick. Thus, after assembly, the present invention is not in any way seen from the exterior of the completed veneer wall. Thus, legs 52 and 54 are not so long as to place cap 50 outside the exterior surface of brick veneer 40. Further, legs 52 and 54 are not so short as to place cap 50 so close to the interior surface of brick veneer 40 that it is not securely embedded in mortar 44.

Cap 50 may be made with serrations 80 so as to be better gripped by mortar 44, and it will be understood that similar serrations may also be located in legs 52 and 54 if a more secure attachment to mortar 44 is desired. In alternative embodiments, legs 52 and 54, and cap 50 may have a corregated surface so as to provide a more secure attachment to mortar 44, if necessary.

In the upper part of FIG. 3, a tie 12 is depicted in a stored position. Cap 50 has a circular cross section 90, as does legs 52 and 54. In cross section, ears 56 and 58 have curved edges 64 and 66 with flats 60 and 62 therebetween. Flats 60 and 62 are substantially perpendicular to the legs 52 and 54. The dimension of slideways 34 and 36 are such that the edges 64 and 66 (FIG. 3) frictionally engage the facing surfaces of base 14 and flanges 16 and 18 when tie 12 is at an acute angle or in the stored, or up, position with respect to base plate 10. Referring now to the lower strap 12 shown in FIG. 3, it can be seen that in this position, flats 60 and 62 on ears 56 and 58 are aligned with slideways 34 and 36 such that they are parallel to base 14 and flanges 16 and 18. Thus, in this position, the brick tie is not locked by the camming action of ears 56 and 58 within slideways 34 and 36 as in the stored position.

As has been described, when ties 12 are substantially perpendicular to base plate 10, the camming action of ears 56 and 58, described above, does not prevent the movement of the ties 12 along the length of base plate 10. However, ties 12 are made from wire and are bent such that their disassembled state is as shown in FIG. 4*a*. Thus, it can be seen that legs 52 and 54 must be flexed inwardly relative to cap 50 such that ears 56 and 58 are engaged within slideways 34 and 36, respectively. When in the engaged position, as shown in FIG. 2, each tie 12 is in tension, and the end of legs 52 and 54 adjacent ears 56 and 58, at points 70 and 72 respectively, engage the confronting faces of flanges 16 and 18. This retains ties 12 in position relative to the longitudinal position of base plate 10.

In use of the invention, as shown in FIG. 1, ties 12 are located at the upper end of base plate 10 substantially in plane or at an acute angle thereto so that each tie is frictionally engaged to base plate 10 by the camming action of ears 56 and 58. As needed, each tie is brought to a perpendicular position and is flexed inwardly by applying a force thereon (as shown in FIG. 4*c*) to bend leg 52 toward leg 54, allowing slidable movement along the length of base plate 10 to a lower position, proximate the surface of a newly layed brick. Mortar and brick is then layed over the brick tie so as to permanently fix the brick tie in the mortar, and thereby permanently fix the brick veneer to the drywall. It will be understood that the ties of the present invention may be placed as desired between layers of bricks, for example between each fifth or sixth row of bricks, as needed. The base plate will normally be from 1 to 2 meters in length and have 6 to 8 ties per plate. This dimension and the number of ties can be readily varied in view of the structure of the invention.

During use, the brick ties of the present invention may be frictionally engaged with the base strap so as to allow easy transportation of the base plate and the plurality of brick ties as single unit to the work site. Further, the brick ties of the present invention provide a further advantage in that they may be securely located at a position well above the layer of bricks being layed so as to be out of the way without necessitating use of the mason's second hand to hold the brick ties in a remote location prior to their use.

Further, the ties of the present invention may be positioned in their stored positions such that they lie completely flat against the base 14 of base plate 10. Thus, the units may be stored completely flat, requiring little unused space, until needed.

Further, it will be appreciated that the present design is one which can be inexpensively manufactured, without castings or other complex components, can be readily designed in any length, can be cut to any length and can accommodate any number of ties per base plate as is desired or as is required by building code or architectual specification. Further, the present tie structure can be easily attached, by use of nails or screws, to any substructure, at any location and can be made of varying dimensions such as to accommodate different masonry building components. Further, it will be appreciated that the present design provides far more positive engagement between the substructure and the masonry veneer than is possible using prior devices. For example, in the present invention, the ties may be positioned exactly to a position such that they are parallel to and overlie the top face of the masonry block or brick. Thus, any movement of the masonry wall is restrained in a positive manner by the present invention.

Although preferred embodiments of the invention have been described in the foregoing Detailed Description and illustrated in the accompanying Drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the invention.

It is claimed:

1. A wall tie unit comprising:

a base plate adapted to be attched to a drywall structure, said base plate having a base with first and second inwardly turned sides, said base and said inwardly turned sides forming first and second longitudinal slideways; and a tie having a cap with a pair of legs extending therefrom and a first ear extending from one leg and a second ear extending from the other leg, said first ear adapted to slidably engage said first longitudinal slideway and said second ear adapted to slidably engage said second longitudinal slideway, said tie being pivotable between a first position where it is substantially perpendicular to said base plate and a second position where it is substantially parallel to said base plate, said legs being spaced apart by a distance permitting compression of said legs toward each other sufficient to clear said legs from contact with said inwardly turned sides without causing said legs to contact each other.

2. The wall tie unit of claim 1 wherein said cap member has serrations therein.

3. The wall tie apparatus of claim 1 wherein said first and second ears further comprise gripping means to frictionally engage said tie to said base plate to selectively prevent longitudinal movement of said tie with respect to said base plate.

4. The wall tie unit of claim 3 wherein said gripping means comprises said first and second ears having a first cross sectional dimension greater than the width of said longitudinal slideways such that when said tie is in a first angular position relative to said base plate, said ears are positioned such that said first dimension is positioned across the span of said slideways to frictionally engage the interior surfaces of said slideways.

5. The wall tie unit of claim 1 wherein said tie is biased inwardly upon engagement of said ears of said tie in said slideways such that said legs of said tie normally engage confronting edges of the inwardly turned sides of said base plate to restrain said tie from longitudinal movement relative to said base plate.

6. The wall tie unit of claim 5 wherein the legs of said tie may flexed one toward the other to selectively disengage said legs from said base strap inwardly turned sides to permit movement of said tie relative to said base plate.

7. A wall tie unit of claim 1 wherein said base plate is attached to a drywall structure in a generally vertical orientation, said base plate having a plurality of said wall ties frictionally engaged in said base plate at an upper interval of said base plate.

8. The wall tie unit of claim 7 wherein said wall ties are progressively slideable downwardly along said base plate to lower positions without removing said wall ties from said base plate.

9. A masonry tie assembly for attaching a masonry structure to an adjacent wall structure comprising:

a base plate adapted to be attached to the adjacent structure, said plate having a back with first and second inwardly folded sides forming first and second slideways;

a tie having a structure for attachment to the masonry structure and comprising a U-shaped member having a cap with legs extending therefrom, a first ear extending from one of said legs and a second ear extending from the other of said legs for slidable engagement in said first and second slideways respectively, to permit selective longitudinal positioning of said tie relative to said base plate, said cap being shorter than the distance between the confronting ends of said first and second inwardly folded sides so that said tie can be pivoted about said ears such that said cap of said tie lies in a stored position between said inwardly folded sides of said base plate.

10. The masonry tie assembly according to claim 9 wherein said tie has serrations therein.

11. The masonry tie assembly according to claim 9 wherein said first and second ears further comprise gripping means for frictionally engaging said tie to said base plate to selectively prevent longitudina movement of said tie with respect to said base plate.

12. The wall tie unit of claim 11 wherein said gripping means comprises said first and second ears having flats on said ears such that the cross sectional dimension of said ears at the flats is less than the width of said slideways such that when said tie is in a first angular position relative to said base plate said flats are substantially perpendicular to said slideways end when said tie is in a second angular position relative to said base plate said flats are substantially parallel to said slideways position, said flats lie adjacent the interior surfaces of said first and second longitudinal channels.

13. The wall tie unit of claim 9 wherein said tie is biased inwardly upon engagement of said ears of said tie in said slideways such that said legs of said tie normally engage confronting edges of the inwardly turned sides of said base plate to restrain said tie from longitudinal movement relative to said base plate.

14. The wall tie unit of claim 13 wherein the legs of said tie may flexed one toward the other to selectively disengage said legs from said base strap inwardly turned sides to permit movement of said tie relative to said base plate.

15. A wall tie unit comprising:

a base plate adapted to be attached to a drywall structure, said base plate having a base with first and second inwardly turned sides, said base and said inwardly turned sides forming first and second longitudinal slideways; and a tie having a cap with a pair of legs extending therefrom and a first ear extending from one leg and a second ear extending from the other leg, said first ear adapted to slidably engage said first longitudinal slideway and said second ear adapted to slidably engage said second longitudinal slideway, said tie being pivotable between a first position where it is substantially perpendicular to said base plate and a second position where it is substantially parallel to said base plate.

said first and second ears having gripping means to frictionally engage said tie to said base plate to selectively prevent longitudinal movement of said tie with respect to said base plate, and comprising said first and second ears having a first cross sectional dimension greater than the width of said longitudinal slideways such that when said tie is in a first angular position relative to said base plate, said ears are positioned such that said first dimension is positioned across the span of said slideways to frictionally engage the interior surfaces of said slideways, and said gripping means further comprising said first and second ears having a second cross sectional dimension les than said first cross sectional dimension and less than the span of said slideways such that when said tie is in a second angular position relative to said base plate, said ears are positioned such that said second dimension is positioned across the span of said slideways to permit movement of said ears in said slideways.

16. The wall tie unit or claim 15 wherein said first position is where said tie is substantially parallel to said base plate.

17. The wall tie unit of claim 15 wherein said second position is where said tie is substantially perpendicular to said base plate.

18. A wall tie unit comprising:

a base plate adapted to be attached to a drywall structure, said base plate having a base with first and second inwardly turned sides, said base and said inwardly turned sides forming first and second longitudinal slideways;

a tie having a cap with a pair of legs extending therefrom and a first ear extendng from one leg and a second ear extending from the other leg, said first ear adapted to slidably engage said first longitudinal slideway and said second ear adapted to slidably engage said second longitudinal slideway, said tie being pivotable between a first position where it is substantially perpendicular to said base plate and a second position where it is substantially parallel to said base plate;

said first and second comprising gripping means to frictionally engage said tie to said base plate to selectively prevent longitudinal movement of said tie with respect to said base plate; and said gripping means comprising said first and second ears having flats on said ears such that the cross sectional dimension of said ears at the flats is less than the width of said slideways such that when said tie is in a first angular position relative to said base plate said flats are substantially perpendicular to said slideways end when said tie is in a second angular position relative to said base plate said flats are substantially parallel to said slideways position, said flats lie adjacent the interior surfaces of said first and second longitudinal channels.

19. The wall tie unit of claim 18 wherein said first position is where said tie is substantially parallel to said base plate.

20. The wall tie unit of claim 18 wherein said second position is where said tie is substantially perpendicular to said base plate.

21. The well tie unit of claim 18 wherein said first position is where said tie is substantially parallel to said base plate.

22. The wall tie unit of claim 18 wherein said second position is where said tie is substantially perpendicular to said base plate.

23. A masonry tie assembly for attachng a masonry structure to an adjacent wall structure comprising:

a base plate adapted to be attached to the adjacent structure, said plate having a back with first and seoond inwardly folded sides forming first and second slideways;

a tie having a structure for attachment to the masonry structure and a first ear and a second ear extending therefrom for slidable engagement in said first and second slideways, respectively, to permit selective longitudinal positioning of said tie relative to said base plate;

said first and second ears having gripping means for frictionally engaging said tie to said base plate to selectively prevent longitudinal movement of said tie with respect to said base plate;

said gripping means comprising said first and second ears having first a cross sectional dimension greater than the width of said first and second slideways such that when said tie is in a first angular position relative to said base plate, said ears are positioned such that said first dimension is positioned across the span of said slideways to frictionally engage the interior surfaces of said slideways.

24. The wall tie unit of claim 23 wherein said first position is where said tie is substantially parallel to said base plate.

25. The wall tie unit of claim 23 wherein said second position is where said tie is substantially perpendicular to said base plate.

* * * * *